US010125587B1

(12) United States Patent
Lockhart

(10) Patent No.: US 10,125,587 B1
(45) Date of Patent: Nov. 13, 2018

(54) SYSTEMS AND METHODS FOR THE IN SITU RECOVERY OF HYDROCARBONACEOUS PRODUCTS FROM OIL SHALE AND/OR OIL SANDS

(71) Applicant: Fire Rock Energy LLC, Salt Lake City, UT (US)

(72) Inventor: Michael D. Lockhart, Chalottesville, VA (US)

(73) Assignee: Fire Rock Energy, LLC, Salt Lake City, UT (US)

( * ) Notice: Subject to any disclaimer, the term of this patent is extended or adjusted under 35 U.S.C. 154(b) by 0 days.

(21) Appl. No.: 15/996,780

(22) Filed: Jun. 4, 2018

(51) Int. Cl.

| | |
|---|---|
| ***E21B 43/24*** | (2006.01) |
| ***E21B 43/295*** | (2006.01) |
| ***E21B 43/34*** | (2006.01) |
| ***E21B 43/12*** | (2006.01) |
| ***E21B 17/02*** | (2006.01) |

(52) U.S. Cl.
CPC ..... *E21B 43/24* (2013.01); *E21B 17/023* (2013.01); *E21B 43/12* (2013.01); *E21B 43/34* (2013.01)

(58) Field of Classification Search
CPC ..... E21B 43/24; E21B 43/295; E21B 36/00; E21B 36/005
USPC ..... 166/302, 57
See application file for complete search history.

(56) References Cited

U.S. PATENT DOCUMENTS

| | | | | |
|---|---|---|---|---|
| 2,908,331 | A * | 10/1959 | Brown | E21B 36/005 166/58 |
| 3,062,289 | A * | 11/1962 | Eades | E21B 36/005 165/45 |
| 3,343,605 | A * | 9/1967 | Phelan, III | E21B 36/005 166/61 |
| 4,928,765 | A | 5/1990 | Nielson | |
| 5,655,605 | A * | 8/1997 | Matthews | E21B 43/121 166/370 |
| 7,048,051 | B2 | 5/2006 | McQueen | |
| 9,777,562 | B2 * | 10/2017 | Lastra | E21B 43/12 |
| 2002/0100587 | A1 * | 8/2002 | Lewis | E21B 36/005 166/303 |
| 2013/0312959 | A1 * | 11/2013 | Hytken | E21B 43/2406 166/272.3 |
| 2016/0208560 | A1 * | 7/2016 | Civelek | E21B 41/0021 |

* cited by examiner

*Primary Examiner* — Kenneth L Thompson
(74) *Attorney, Agent, or Firm* — Davidson Berquist Jackson & Gowdey, LLC

(57) ABSTRACT

Systems and methods are described for the in situ recovery of hydrocarbonaceous products from nonrubilized oil shale and/or oil sands. The inventive system comprises a closed loop, in-ground radiator that is suspended from a support cable (or rod) along with support bracket(s) and perforated outer casing sections into a borehole, in order to target and heat kerogen and/or bitumen within oil shale and/or oil sand deposits, and to collect the resultant hydrocarbonaceous product gases from the borehole without the need for separating processing gases and/or liquids. The inventive system avoids the drawbacks associated with "open" systems including the mixing of processing and product gases, and the problems historically associated with control and management of prior art in situ recovery systems.

30 Claims, 5 Drawing Sheets

SYSTEMS AND METHODS FOR THE IN SITU RECOVERY OF HYDROCARBONACEOUS PRODUCTS FROM OIL SHALE AND/OR OIL SANDS

FIELD OF INVENTION

The present invention relates generally to apparatus and methods for recovering hydrocarbonaceous products from oil shale or oil sand with reduced environmental impact and improved safety.

BACKGROUND OF THE INVENTION

Oil shale is a term used to refer to sedimentary rock compositions typically comprised of layers of clay and sand mixed with other inorganic compounds including, for example, calcium carbonate, calcium magnesium carbonate, and iron compounds. Also within this sedimentary rock are dispersed pockets of complex organic compounds known as "kerogen." If the oil shale is heated, typically between 600 and 1000 degrees F., the kerogen is pyrolyzed to produce various carbonaceous petroleum products including, for example, oil, gas, and other residual carbon products. Similarly, oil or tar sands are types of naturally occurring bitumen deposits within sand or clay.

Typically, processing for the recovery of carbonaceous products from oil shale (or oil/tar sands) is divided into one of two general categories, above-ground processing or in ground (in situ) processing. Above ground processing involves the physical mining of the oil shale rock and its subsequent processing above ground to obtain the desired hydrocarbonaceous products. In contrast, in situ processing includes heating the oil shale rock underground in order to pyrolyze the kerogen and bitumen materials to produce hydrocarbonaceous products from the rock in situ. These hydrocarbonaceous products are then collected and further processed above ground. Historically above ground processing is typically more efficient because a high percentage of the kerogen contained in the mined rock is processed, it is also more expensive due to the process of physically mining the rock and bringing it to the surface or extensive strip mining for processing. Such above ground processing is also detrimental to the environment because of the displacement of significant amounts of rock, and environmental contamination due to the mining process whether in the form of dust, tailings, and/or groundwater contamination. Moreover, mining is notoriously dangerous. Conversely, in situ processing is less expensive because the rock is not mined, but rather processed in place. However, to date in situ processing has been less efficient at producing the hydrocarbonaceous products from the rock, which requires significant penetration through the rock by the processing heat, and the subsequent diffusion of the hydrocarbonaceous products back through the rock for collection.

Many prior art in situ processes also use "rubilization" or the breaking up of the oil shale formation to increase its permeability. Rubilization is typically conducted by generating underground explosions that are both expensive and potentially detrimental to the environment. For example, while rubilization can lead to increased permeability within the rock formation, which in turn permits improved flow of gases and liquids within the rock, rubilization can also complicate the extraction process by giving the carbonaceous gases and liquids alternate paths of escape, resulting in lower extraction yield as well as potential environmental contamination. As such it is desirable to avoid rubilization.

U.S. Pat. No. 4,928,765 to Neilson discloses in situ recovery of carbonaceous products from oil shale without rubilization. Neilson discloses placing a gas-fired heater assembly into a borehole within the oil shale formation. Once the gas-fired heater is lowered into the borehole, fuel gas and combustion air are introduced from above ground into the heater assembly, which is heated to between 1000 and 1500 degrees F. When the heater is maintained at those temperatures, heat radiates outward from the heater to create a cylindrical reaction zone within the oil shale formation. As the reaction zone reaches the desired temperature, the kerogen within the rock is pyrolyzed resulting in formation of natural gas, which is then extracted, brought to the surface, and further processed. As Neilson is a "closed system," the combustion gases and exhaust gases are contained within the heater assembly, and are never mixed with the hydrocarbonaceous products, which are extracted from oil shale rock through a separate pipe from the borehole. However, the Neilson process has several drawbacks. First, the borehole Neilson used was large, typically on the order of 20 plus inches, which was necessary to allow the burner/heater to fit down the well, but which led to poor structural integrity of the borehole. Further, while an increase in oil shale heat transfer efficiency is produced above 1000° F., a significant increase in the loss of vertical structural integrity is also observed, especially in formations where large amounts of carbonate minerals are present. Also, control and management of the Nielson heater system was difficult and dangerous, particularly the feeding of the engine fuel and oxygen from the surface. Because of these drawbacks, Neilson was unable to utilize his system in wells below depths of about 100 feet. Further, while Neilson's process created a cylindrical reaction zone at the bottom of the borehole, the heat in the well dissipated quickly, thereby limiting the effective reaction zone to the area near the heater.

U.S. Pat. No. 7,048,051 to McQueen et al. and its progeny disclose a different "open system" approach where, instead of using a heater assembly within a borehole, processing gases are introduced directly into a borehole and used to create a conductive and radiant non-burning thermal energy front sufficient to convert the kerogen in oil shale or bitumen in oil sand into hydrocarbonaceous products. In this open system, the liberated hydrocarbonaceous gases diffuse back through the rock formation to the borehole where they mix with the processing gases, which are then extracted together from the borehole. Once outside the borehole, a variety of processes are used to recover the hydrocarbonaceous products from the processing gases. However, McQueen's method also has various drawbacks. For example, the McQueen process requires the capping and pressurization of the entire borehole and the maintenance of a sub-atmospheric pressure relative to the well inlet pressure to insure a positive flow of the combustion and product gases. Such a pressurized system requires precise control of the system pressure to avoid undesired backflow and possibly explosions. In addition, because the McQueen system is open, it is imperative to keep the inlet clear to permit the processing gases to continue to enter the borehole. However, during processing, rock and sediment from the sides of the borehole can fall into the bottom of the well (sluff) and block the processing gas inlet. In addition, the McQueen process requires an elaborate support structure above ground to support the weight of the system components within the borehole, yet permits for the substantial expansion of the system components within the well as the system is heated. Further, unlike the closed system of Neilson, the McQueen process mixes numerous undesired products from combustion gases and/or makeup gases with the product gases, which requires additional steps to manage.

Many prior art processes are directed to recovery of carbonaceous products from what has been termed the "mahogany layer" or "mahogany zone" of the oil shale, which can be found anywhere from near or on the surface to 2000 feet deep. This mahogany zone is a very rich deposit, typically having a Fischer assay of approximately forty-five gallons per ton or more. Both the Neilson and McQueen patents describe a system targeting all of the potential oil shale layers in a cylindrical payzone, not just the rich mahogany zone.

As such, an in situ process is desired that can target the mahogany zone, does not require sub-surface rubilization, that can be used in deeper wells without the structural, process control, and safety issues associated with open systems such as McQueen, and which does not require the separation of processing gases from extracted hydrocarbonaceous product gases.

In addition AMSO targeted the Illitic oil shale (a clay based oil shale) layer found below the nachrolite layers around 2000 ft. deep. This process, which went through several iterations, used two wells including a heater well and an adjoining recovery well. Along with most other in situ efforts, this process heated the kerogen and recovered the products through a recovery well once a reservoir developed. All efforst to create reservoirs have seen little success to date.

SUMMARY OF THE PRESENT INVENTION

The present invention avoids the drawbacks of the prior art by providing apparatus and methods for extracting hydrocarbonaceous products from oil shale or oil sands without the need for rubilization, without having to separate the hydrocarbonaceous product gases from the processing gases, and by effectively maintaining heat transfer throughout the entire length/depth of the radiator and subsequently into the oil shale deposits.

The present invention comprises a system that is suspended in a borehole by a cable sufficient to support the components of the system, typically made of stainless steel. This cable provides all of the structural and weight support of the in ground components of the system, thereby avoiding the problems associated with prior art support systems and allowing for significantly reduced material specifications and costs. All sub-surface components are made from the same material as the support cable, typically stainless steel, to minimize expansion/contraction issues of the various components upon heating and cooling. The heating system comprises several components; starting with a radiator disposed within a perforated outer casing that lines the wall of the borehole. Heated gases or liquids can be heated on the ground surface, and are then pumped down to the suspended radiator through an inlet pipe or line. Once the heated gas or liquid enters the radiator, it transfers its heat out through the perforated casing and toward the inner wall of the borehole surrounding the heating system. As an in ground "closed" system, the processing gas or liquid is then pumped back to the surface through a return pipe or line where it can be reclaimed or exhausted, as desired. Heating of the processing gases or liquid can be performed by a variety of methods including through combustion, heat exchanger, or through solar heating. This radiator exists at all levels within the well to insure complete and efficient well heating at the desired temperature. In addition, electric heaters can also be used either in place of, or to augment, the radiator.

As the reaction zone in the rock around the heating system reaches a temperature of between 600 and 1000 degrees F., the subsurface kerogen begins to pyrolyze. This causes a breakdown of the non-permeable kerogen layers into very permeable layers with the path of least resistance flowing back towards the heating pipe. Gasification occurs as gas is liberated, flowing through fissures in the oil shale rock back into the borehole where it passes back through the perforated casing and can be extracted at the surface. As an in ground closed system, there are no processing gases or liquids to be separated from this product gas. Typically, upon return to the surface some of the hot gas is cooled and condensed and can be separated using known condenser techniques. To assist in the gasification, barometric pumping can be utilized on the surface to create a reduced pressure environment within the borehole, which in turn reduces the boiling points of the various pyrolysis components of the kerogen.

In another embodiment of the invention, the heating system can be used in non-vertical, "seam" drilling, whereby the well is drilled into a seam either horizontally or at an angle thereby drilling the entire well within a "seam" of high concentration oil shale. Such seam drilling is especially useful to avoid groundwater contamination. In such situations, the heater system's suspension cable is replaced with a stainless steel rod to support the perforated pipe and heater system.

BRIEF DESCRIPTION OF THE DRAWINGS

In FIG. 1, a borehole is shown that is drilled through overburden and into the formation of oil shale 400. Once the borehole is drilled to the desired depth, the wall of the borehole is lined with a cylindrical casing 100, made of perforated stainless steel of a diameter slightly smaller than the borehole. Heat source 500 is provided on the surface, and processing gases and/or liquids under a flow control system (not shown) are transported to and from a radiator 300 suspended within the outer casing wall by support cable 200.

DETAILED DESCRIPTION OF THE INVENTION

Figure 1:
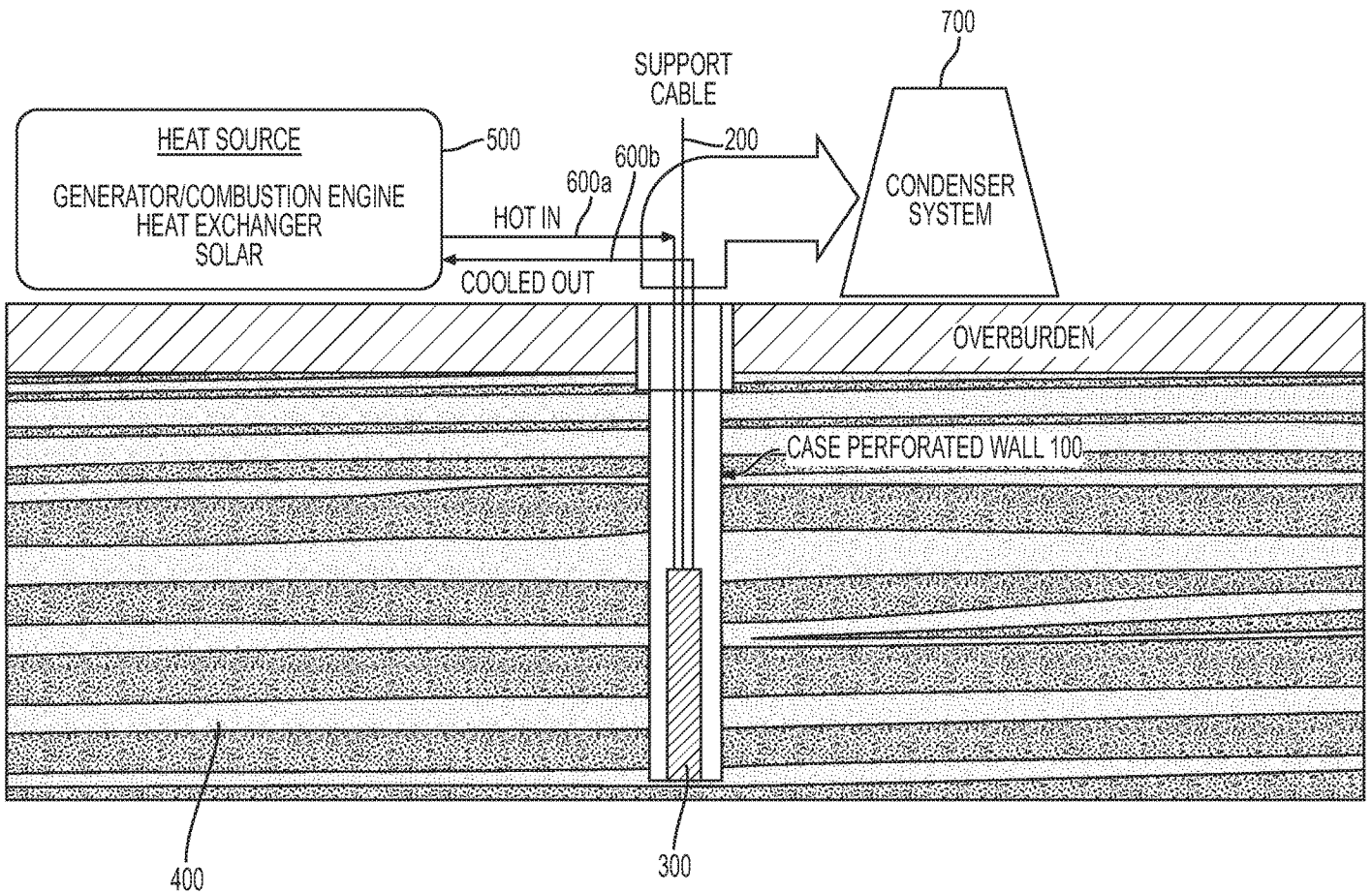
FIG. 1 illustrates a vertical well embodiment of the present invention.

Referring to FIG. 1, the present invention is directed to an apparatus and method of recovering hydrocarbonaceous products such as gas from underground oil shale rock. Oil shale formations are typically found at depths of between 100 to 3000 feet below the surface. Generally, as shown in the embodiment of FIG. 1, a borehole is drilled through the "overburden" or surface material and into the kerogen-containing oil shale formation. In the present invention, the width of the borehole is typically less than nine 9 inches in diameter. Once the borehole is drilled, the hole is lined with a perforated casing 100 typically made of stainless steel, such as 316L stainless steel, although other materials of sufficient strength and heat transfer properties may be used. The perforated casing can be installed along with the radiator 300 and is lowered and suspended by a cable 200, also typically made of 316L stainless steel, inside the casing to its desired depth depending on the location of the high-yield kerogen "pay zones" within of the formation, 400. A heating source 500, is placed above ground and connected to the ingress line 600*a* providing heated processing gases or liquids to the suspended radiator 300, and egress line 600*b* is provided to bring the cooled exhaust gases or liquid back to the surface for heating or exhausting. The top of the borehole is configured such that pyrolyzed product gases from the heating of the kerogen can be collected using a flow management system and fed into a surface condenser system 700 for separation and further processing.

Figure 2B:
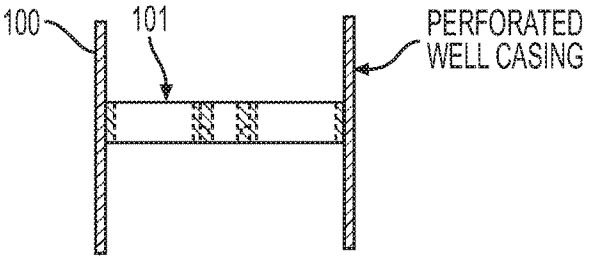
FIG. 2A illustrates a top view of the inventive heating system comprising the perforated cylindrical outer casing 100, typically made of stainless steel, which contains perforations (the size and numbers of perforations in the casing is dependent on borehole geology the goal being to maximize pyrolyzed oil shale recovery while minimizing borehole sluff) and which is lined along the depth of the borehole shown in FIG. 1. The perforations can be of any size or shape sufficient to permit radiative heat to flow from the heater inside the casing to the surrounding rock in the borehole, and to permit product gases of gasification to return to the borehole for extraction. As FIG. 2B illustrates the cross-sectional view of the outer casing with one support bracket 101 that is connected to the inner diameter of the perforated casing 100. The support bracket 101, has a support cable hole 102 that permits attachment of the support cable that suspends the bracket(s) 101, the perforated casing sections 100 and the radiator 300 (as shown in FIG. 1). The support bracket also includes two holes therein 103 of sufficient diameter to permit the ingress and egress of processing gases or liquids to the heater within the casing. In addition, support bracket 101 optionally may also contain electrically insulated holes 104 that permit optional electrical heating elements within the casing to be accessed and powered.
Figure 2A:
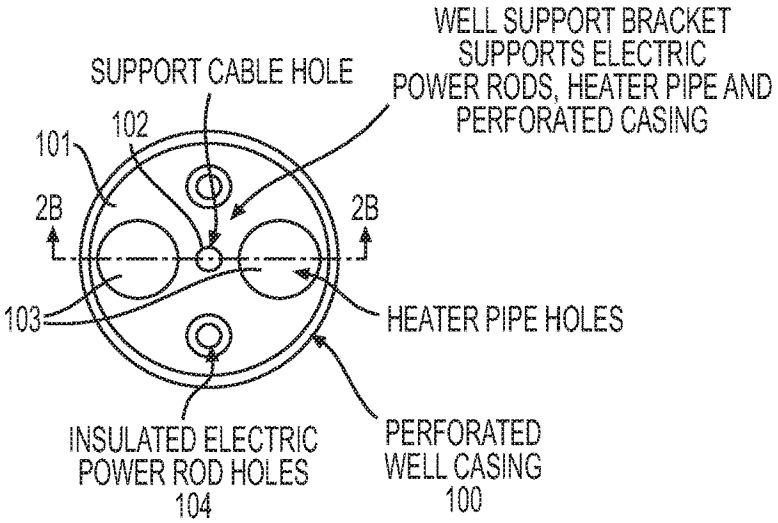
Figure 3:
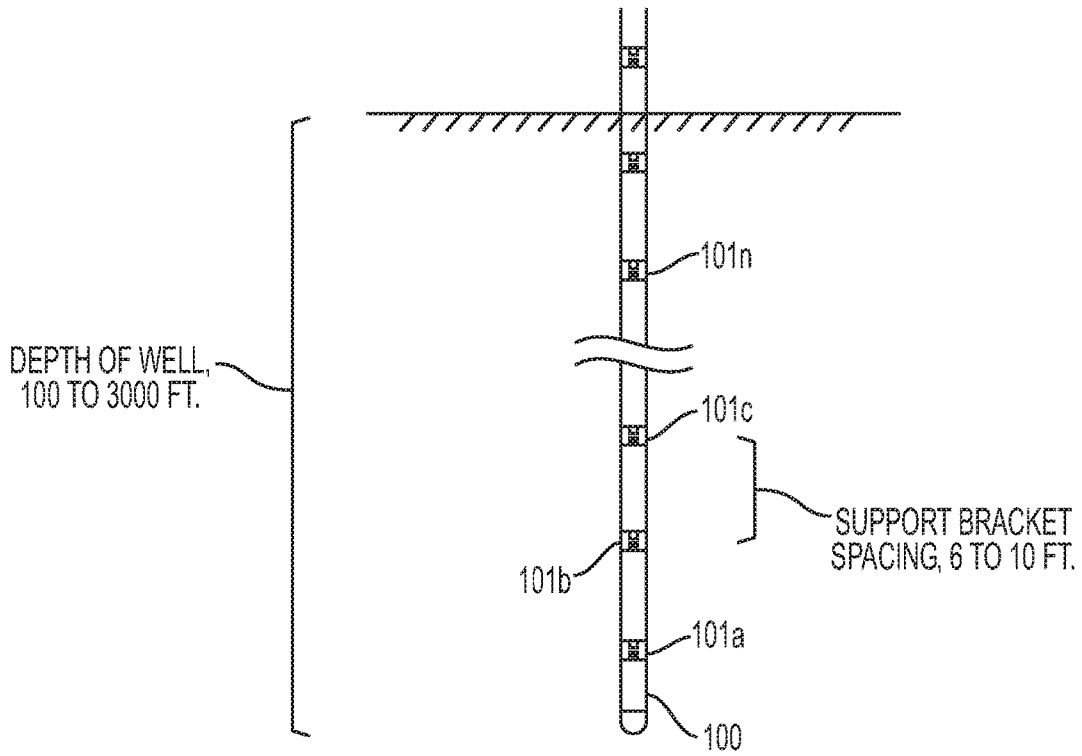
FIG. 3 illustrates another embodiment of the present invention, whereby multiple support brackets 101*a*-101*n*, are disposed along the inner diameter of the perforated casing 100, at spacing of approximately 6 to 10 feet between support brackets. The exact spacing distance of the support brackets will be dependent upon various variables such as the width of the casing and the associated weight of successive portions of the casing such that adequate support of the structure is provided by the support brackets and suspending cable.

As shown in FIGS. 2A and 2B, attached to the inner diameter of the perforated casing 100 is at least one, and preferably multiple support brackets 101 that are attached to the casing (normally bolted) and which further contains a hole 102 for the connection of the support cable (not shown) as described in FIG. 1 above. The support cable can be connected to the support bracket in any number of ways including, but not limited to, direct clamping. In addition, support bracket 101 will also contain holes 103 that permit passage of the ingress line (not shown) and egress line (not shown) to and from the surface heating source and the suspended heater 300 (shown in FIG. 1). Further, support bracket 101 may also have electrically insulated holes 104 that permit the passage of electrical power lines for any optional electrical heating elements within the heater system. FIG. 3 illustrates an embodiment where the vertical well has more than one support bracket 101*a*-101*n*, disposed along the depth of the outer casing. Depending on the weight of the outer casing, support brackets, and heater, the support brackets are typically spaced between 6 to 10 feet from one another.

Figure 4:
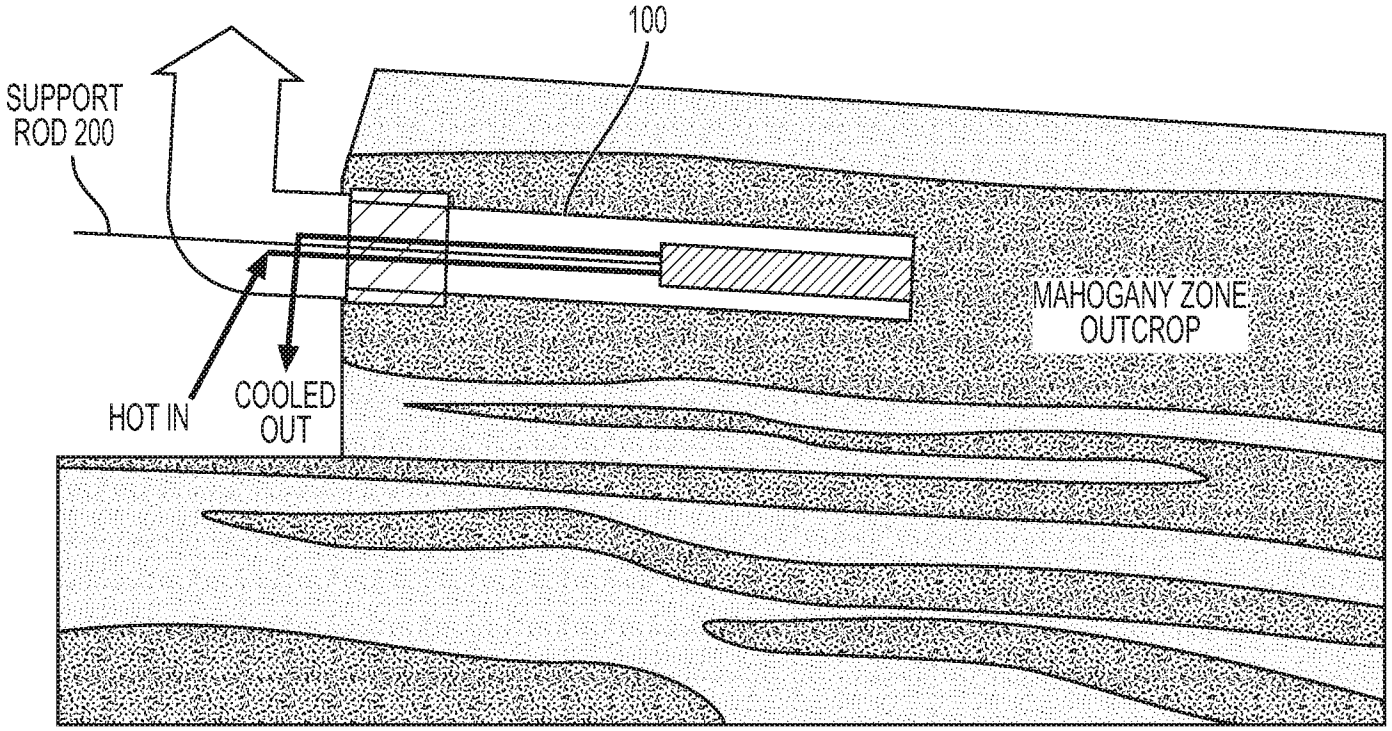
FIG. 4 illustrates another embodiment of the present invention, whereby the heater system is used in non-vertical or seam drilling. In this embodiment, the entire depth of the well is drilled at a non-vertical angle such that the majority, if not the entirety, of the well is drilled into a "seam" or layer of rich mahogany zone oil shale. In many cases the borehole will be horizontal, or angled depending on the alignment of the mahogany zone. As with the vertical well embodiment, the stainless steel perforated casing 100 is placed along the entire depth (horizontal length) of the borehole. Support brackets are again placed within the perforated casing at required spacing, with the use of a stainless steel rod 200 supporting the brackets and heater within the casing rather than a cable as used in the vertical alignment. The support brackets otherwise have the same structure as those used in the vertical well embodiment.
Figure 5B:
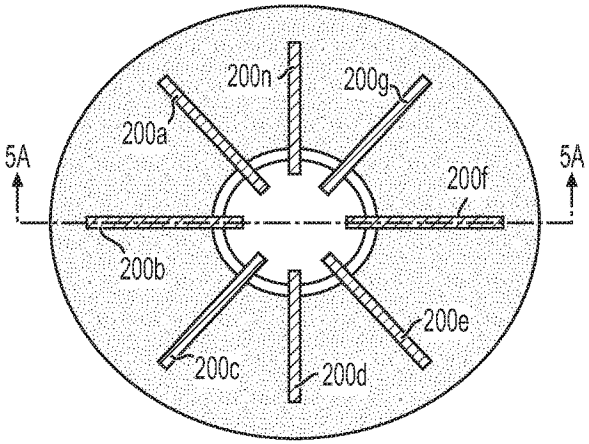
FIGS. 5A and 5B illustrate another embodiment of the invention whereby a series of horizontal seam wells are drilled into a rich mahogany layer from a centralized shaft of between 20-50 feet in diameter. As shown in cross sectional FIG. 5A, a number of subsurface platform seam wells can be drilled out radially from the centralized shaft in various directions. The number and placement of the wells will be dependent on the size of the mahogany layer being serviced. For example, as shown in a top view in FIG. 5B, horizontal wells 200*a*-200*n* of between 100 to 10,000 feet can be drilled radially from the centralized shaft. Further, as shown in FIG. 5A, multiple layers of such horizontal seam wells can be drilled at different depths along the centralized shaft. The size of the centralized shaft will be dependent on the number of seam wells within the shaft, and must be of sufficient size to support the weight and processing gas ingress/egress lines for the various wells.
Figure 5A:
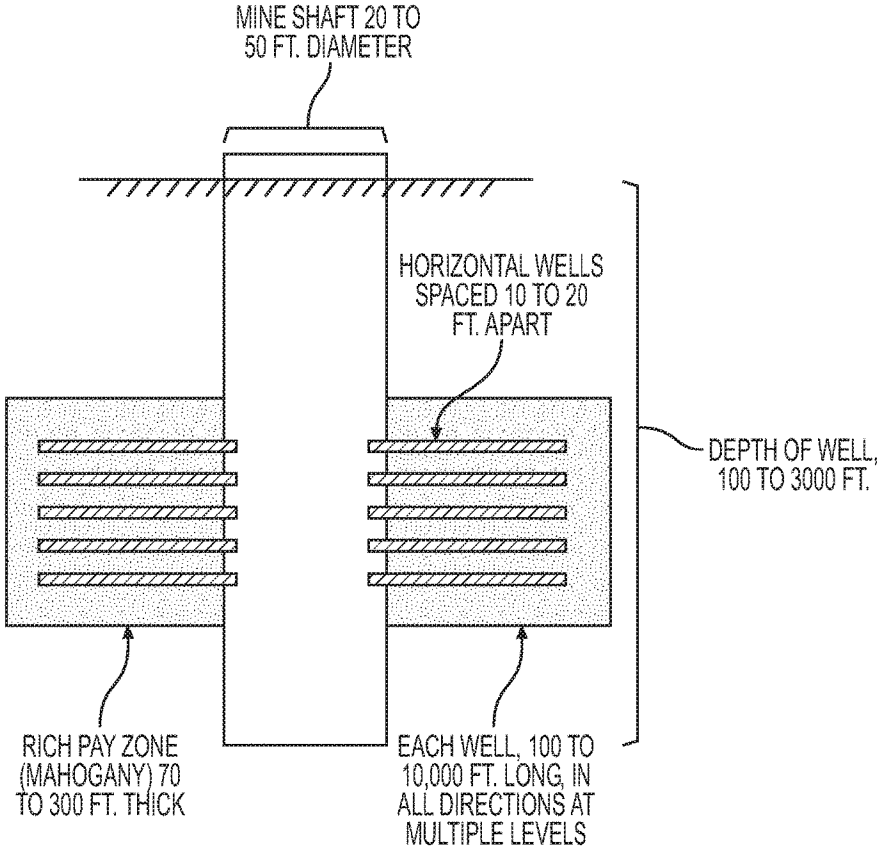

FIG. 4 show an alternative embodiment for non-vertical boreholes, such as those used in horizontal or nearly horizontal seam wells. In some situations, for example when a rich mahogany layer or seam is found and is accessible, it may be desirable to drill the well such that it is entirely within the rich mahogany zone. As shown in FIG. 4, such a configuration is similar to that used in vertical wells, however instead of using a supporting cable, the system uses a supporting rod 200, again typically made of stainless steel but can be of any material of sufficient strength to support the weight of the heater and its components. Using such horizontal or angled wells, it is possible to configure subsurface platform wells such as those shown in FIGS. 5*a* and 5B. More specifically, a centralized "mine" shaft of between 20 to 50 feet in diameter can be excavated until the mahogany zone is reached—typically 70 to 300 feet below the surface. The centralized shaft must be wide enough to support all equipment and lines necessary to support a series of horizontal or nearly horizontal seam wells, 200*a*-200*n* as shown in top view in FIG. 5B, that are drilled radially outward from the centralized shaft. Such horizontal or nearly horizontal seam wells can be from 100 to 10,000 feet in length from the centralized shaft. Further, as shown in top view in FIG. 5A, depending on the thickness of the mahogany layer, it may be possible to establish multiple levels of such radially disposed horizontal or nearly horizontal seam wells extending from the centralized shaft. Each of the horizontal or nearly horizontal seam wells in each level will each contain a perforated outer casing, at least one, and preferably multiple, support brackets, and a heater supported by a support rod attached to the support bracket(s) as described previously in FIG. 4.

Those skilled in the art will appreciate that alterations to the above-described apparatus and process can be made without departing from the scope of the invention.

I claim:

1. A system for the in situ recovery of hydrocarbonaceous products from oil shale and/or oil sands comprising:

a support cable sufficient to support components of a heating system within a borehole;

at least one support bracket that is connected to the support cable, and which is connected to a perforated outer casing that lines the borehole, wherein the support bracket contains at least one passage way for ingress and at least one passage way for egress of process gases and/or liquids to and from a radiator suspended from the at least one support bracket and disposed within the perforated outer casing, wherein said radiator is positioned within a desired zone within the borehole corresponding to a location of kerogen-rich portions of the oil shale formation or bitumen-rich portions of the oil sand formation;

an above ground heat source and associated flow control system for provision of heated process gases and/or liquids to the suspended radiator;

an ingress line that brings the heated process gases and/or liquids from the above ground heat source through the at least one support bracket to the suspended radiator;

an egress line that brings cooled process gases and/or liquids from the suspended radiator through the at least one support bracket and back above ground for reheating or exhausting; and a flow management system that collects product gases from a top of the borehole.

2. The system of claim 1 wherein the support cable, at least one support bracket, perforated outer casing, and radiator are all made of stainless steel.

3. The system of claim 1 wherein the support cable, at least one support bracket, perforated outer casing, and radiator are all made of 316L stainless steel.

4. The system of claim 1, further comprising at least one electric heating element disposed within the perforated outer casing.

5. The system of claim 4 wherein the at least one support bracket further comprises at least one electrically insulated passage way, thereby permitting access to and powering of the at least one electric heating element disposed within the perforated outer casing.

6. The system of claim 1 wherein the at least one support bracket comprises plural support brackets connected to the support cable and spaced at distances of about 6 to 10 feet, and wherein each of the plural support brackets is connected to a corresponding section of the perforated outer casing, and wherein each of the plural support brackets contains at least one passage way for ingress and at least one passage way for egress of process gases and/or liquids to a corresponding radiator suspended from each of the plural support brackets and disposed within each of the corresponding sections of the perforated outer casing.

7. The system of claim 6, wherein each of the plural support brackets further comprises at least one electrically insulated passage way, thereby permitting access to and powering of at least one electric heating element disposed within each of the corresponding sections of the perforated outer casing.

8. A process for the in situ recovery of hydrocarbonaceous products from a subterranean oil shale and/or oil sand formation comprising the steps of:

providing a borehole in an oil shale and/or oil sand formation;

placing a heating system in the borehole including placing a cable into the borehole wherein the cable is attached to at least one support bracket which is disposed within and connected to a perforated outer casing that lines the borehole, the at least one support bracket having at least one passage way for ingress and at least one passage way for egress of process gases and/or liquids to and from a radiator suspended from the at least one support bracket and disposed within the perforated outer casing, providing an above ground heat source;

providing an ingress line and an egress line with a flow management system to permit a flow of heated process gases and/or liquids to and from the suspended radiator; and providing a collection line at a top of the borehole and connected to the flow management system to collect and transport hydrocarbonaceous products from the borehole to ground level.

9. The process of claim 8 wherein the support cable, at least one support bracket, perforated outer casing, and radiator are all made of stainless steel.

10. The process of claim 8 wherein the support cable, at least one support bracket, perforated outer casing, and radiator are all made of 316L stainless steel.

11. The process of claim 8 wherein the heat source is augmented by at least one electric heating element disposed within the perforated outer casing and wherein the at least one support bracket further contains at least one electrically insulated passage way for of providing electrical power to said at least one electric heating element.

12. The process of claim 8 wherein the at least one support bracket comprises plural support brackets attached to said cable and spaced at distances of approximately 6 to 10 feet, and wherein each of the plural support brackets is disposed within and connected to a corresponding section of the perforated outer casing that lines the borehole, and wherein each of the plural support brackets contains at least one passage way for ingress and at least one passage way for egress of process gases and/or liquids to and from a corresponding radiator suspended from each of the plural support brackets and disposed within each of the corresponding sections of the perforated outer casing.

13. The process of claim 12 wherein each of the plural support brackets further contains at least one electrically insulated passage way for providing electrical power to at least one electric heating element disposed within each of the corresponding sections of the perforated outer casing.

14. A system for the in situ recovery of hydrocarbonaceous products from oil shale and/or oil sands comprising:

a support rod sufficient to support components of a heating system within a borehole;

at least one support bracket that is connected to the support rod, and which is connected to a perforated outer casing that lines the borehole, wherein the at least one support bracket contains at least one passage way for ingress and at least one passage way for egress of process gases and/or liquids to and from a radiator suspended from the at least one support bracket and disposed within the perforated outer casing, wherein the suspended radiator is positioned within a zone within the borehole corresponding to a location of kerogen-rich portions of the oil shale formation or bitumen-rich portions of the oil sand formation;

an above ground heat source and associated flow control system for providing heated process gases and/or liquids to the suspended radiator;

an ingress line that brings the heated process gases and/or liquids from the above ground heat source through the at least one support bracket to the suspended radiator;

an egress line that brings cooled process gases and/or liquids from the suspended radiator through the support bracket and back above ground for reheating or exhausting; and a flow management system that collects the product gases from the entrance of the borehole.

15. The system of claim 14 wherein the support rod, at least one support bracket, perforated outer casing, and radiator are all made of stainless steel.

16. The system of claim 15 wherein the support rod, at least one support bracket, perforated outer casing, and radiator are all made of 316L stainless steel.

17. The system of claim 14, further comprising at least one electric heating element disposed within the perforated outer casing.

18. The system of claim 17 wherein the at least one support bracket further comprises at least one electrically insulated passage way, thereby permitting access to and powering of the at least one electric heating element disposed within the perforated outer casing.

19. The system of claim 14 wherein the at least one support bracket comprises plural support brackets connected to the support rod and spaced at distances of about 6 to 10 feet, and wherein each of the plural support brackets is connected to a corresponding section of perforated outer casing, and wherein each of the plural support brackets contains at least one passage way for ingress and at least one passage way for egress of process gases and/or liquids to a radiator suspended from each of the plural support brackets and disposed within each of the corresponding sections of the perforated outer casing.

20. The system of claim 19, wherein each of the plural support brackets further comprises at least one electrically insulated passage way, thereby permitting access to and powering of at least one electric heating element disposed within each of the corresponding sections of the perforated outer casing.

21. A process for the in situ recovery of hydrocarbonaceous products from a subterranean oil shale and/or oil sand formation comprising the steps of:

providing at least one borehole in an oil shale and/or oil sand formation, wherein the borehole is horizontal or nearly horizontal such that the majority of the borehole is within a layer of oil shale and/or oil sands;

placing a heating system in the borehole including a placing a support rod into the borehole wherein the support rod is attached to at least one support bracket which is disposed within and connected to a perforated outer casing that lines the borehole, the at least one support bracket having at least one passage way for ingress and at least one passage way for egress of process gases and/or liquids to and from a radiator suspended from the support rod and disposed within the perforated outer casing, providing an above ground heat source;

providing an ingress line and egress line with an associated flow control system to permit a flow of heated process gases and/or liquids to and from the suspended radiator; and providing a collection line at the top of the borehole and connected to a flow management system to collect and transport hydrocarbonaceous products from the borehole to ground level.

22. The process of claim 21 wherein the support rod, at least one support bracket, perforated outer casing, and radiator are all made of stainless steel.

23. The process of claim 21 wherein the support rod, at least one support bracket, perforated outer casing, and radiator are all made of 316L stainless steel.

24. The process of claim 21, further comprising at least one electric heating element disposed within the perforated outer casing.

25. The process of claim 24 wherein the at least one support bracket further comprises at least one electrically insulated passage way, thereby permitting access to and powering of the at least one electric heating element disposed within the perforated outer casing.

26. The process of claim 21 wherein the at least one support bracket comprises plural support brackets connected to the support rod and spaced at distances of about 6 to 10 feet, and wherein each of the plural support brackets is connected to a corresponding section of the perforated outer casing, and wherein each of the plural support brackets contains at least one passage way for ingress and at least one passage way for egress of process gases and/or liquids to and from a corresponding radiator suspended from each of the plural support brackets and disposed within each of the corresponding sections of the perforated outer casing.

27. The process of claim 26 wherein each of the plural support brackets further comprises at least one electrically insulated passage way for providing access to and powering of at least one electric heating element disposed within each of the corresponding sections of the perforated outer casing.

28. The process of claim 21 wherein multiple boreholes are provided that are radially extended from a common mine shaft, wherein each borehole contains a separate heating system including a support rod attached to at least one support bracket which is disposed within and connected to a perforated outer casing that lines each borehole, the at least one support bracket having at least one passage way for ingress and at least one passage way for egress of process gases and/or liquids to and from the radiator suspended from the support rod and disposed within the perforated outer casing, and wherein said above ground heat source provides heated process gases and/or liquids to and from the suspended radiators within the multiple boreholes via ingress lines and egress lines using an associated flow management system, and providing collection lines at the end of each borehole with an associated flow management system to collect and transport hydrocarbonaceous products from each borehole to ground level via the common mine shaft.

29. The process of claim 28 wherein each of the support rods, at least one support bracket, perforated outer casing, and radiators in each borehole are all made of stainless steel.

30. The process of claim 29 wherein the support rod, at least one support bracket, perforated outer casing, and radiator are all made of 316L stainless steel.

* * * * *